United States Patent [19]

O'Donnell et al.

[11] Patent Number: 4,852,873

[45] **Date of Patent: * Aug. 1, 1989**

[54] EXERCISE DEVICE

[75] Inventors: Jerry L. O'Donnell; Cecil W. Bopp, both of Waterloo, Iowa

[73] Assignee: For You, Inc., Waterloo, Iowa

[ * ] Notice: The portion of the term of this patent subsequent to Jan. 12, 2005 has been disclaimed.

[21] Appl. No.: 141,619

[22] Filed: Jan. 7, 1988

Related U.S. Application Data

[63] Continuation-in-part of Ser. No. 847,760, Apr. 3, 1986, Pat. No. 4,718,666.

[51] Int. Cl.[4] ..... A63B 21/02

[52] U.S. Cl. ..... 272/137; 272/67

[58] Field of Search ..... 272/137, 135, 140, 67, 272/68; 403/223, 229

[56] References Cited

U.S. PATENT DOCUMENTS

| | | | |
|---|---|---|---|
| 134,527 | 1/1873 | Eastman | 272/142 |
| 826,102 | 7/1906 | Hersey | 403/229 |
| 839,260 | 12/1906 | Benson | 403/229 |
| 1,638,003 | 8/1927 | Neumann | 272/67 |
| 1,638,196 | 8/1927 | Guth | 272/68 |
| 1,680,901 | 8/1928 | Meyer | 272/137 |
| 1,729,399 | 9/1929 | Noe | 272/137 |
| 2,714,008 | 7/1955 | Urban | 272/137 |
| 2,714,009 | 7/1955 | Urban | 272/137 |
| 2,765,580 | 10/1956 | Herrschaft | 403/223 |
| 2,965,349 | 12/1960 | Hutton | 403/223 |
| 3,069,161 | 12/1962 | Melchiona | 272/67 |
| 4,006,895 | 2/1987 | Di Laurencio | 272/67 |
| 4,023,808 | 5/1977 | Hebert | 272/137 |
| 4,249,729 | 2/1981 | Gabrielidis | 272/137 |
| 4,304,402 | 12/1981 | Ripp | 272/137 |
| 4,332,380 | 6/1982 | Cardin | 272/137 |
| 4,379,552 | 4/1983 | Webb et al. | 272/67 |
| 4,489,937 | 12/1984 | Kong | 272/137 |

FOREIGN PATENT DOCUMENTS

| | | | |
|---|---|---|---|
| 338019 | 6/1921 | Fed. Rep. of Germany . | |
| 245458 | 2/1926 | Italy | 272/68 |
| 2587 | 2/1899 | United Kingdom | 272/135 |
| 433319 | 8/1935 | United Kingdom . | |

*Primary Examiner*—Richard J. Apley
*Assistant Examiner*—J. Welsh
*Attorney, Agent, or Firm*—Zarley McKee, Thomte, Voorhees & Sease

[57] ABSTRACT

An exercise device produced by a process, including oppositely disposed handle members having outer gripping portions and inner portions to which are attached flange members. An elastromeric middle member is molded at least over the flange members which connects the handle members into a unitary bar-like exercise device. The molding of the middle member encapsulates the flange members to provide a secure and non-releasable junction. The middle member, being deformable and twistable, allows many different types of exercise movements of the handle members. The middle member provides resistance to such deforming and twisting movements and also resiliently returns the handle members to an original position after deformation or twisting of the middle member.

The invention can take on many shapes and forms. An alternative embodiment includes an elastomeric middle member which includes arms extending from oppsoite ends of the middle member. The arms can be secured to the middle member by being force fit into the middle member, by being encapsulated by the middle member, and can take on many different shapes and forms. Additionally, and optionally, the bonding material can be applied to the arms which enhances the securement. Any number of different types of attachments can be releasably secured to the arms. Different types of handles, or types of attachment members can be interchangeables upon the arms, or can be permanently secured to the arms. The exercise device can be optionally secured to an external object, such as an exercise bar or hospital bed. The exercise device can also have arm attachments which allow it to be used by the user's legs, or by a combination of leg and arm. Other combinations are available.

7 Claims, 10 Drawing Sheets

EXERCISE DEVICE

This is a continuation-in-part of copending application Ser.No. 847,760 filed on Apr. 3, 1986, now U.S. Pat. No. 4,718,666.

BACKGROUND OF THE INVENTION

1. Field of the Invention

The present invention relates to an exercise device and its method or process of production, and in particular, to an exercise device produced to be used for development of the hands, wrists, arms, legs, and other parts of the body.

2. Problems in the Art

The benefits and value of exercising have in recent years become increasingly examined and acclaimed. Innumerable types and kinds of exercise equipment have been developed in response to the emphasis on exercise.

Many of these devices are complex, cumbersome, and expensive, many times so much so that it becomes prohibitive for individual exercisers to obtain such devices for personal use.

Therefore, much development has taken place in producing uncomplicated, economical, and manageable exercise devices and equipment for personal or at-home use. Exercising then can be accomplished simply and economically. This gives greater incentive to exercisers and hopefully promotes adherence to a continuing exercise program.

Uncomplicated and economical exercise devices for the upper body, and in particular the hands, wrists, arms, chest, and back, are very prevalent. Many of these devices utilize handles or hand gripping portions which the exerciser moves in response to some resistance to achieve exercise benefit. While many of these devices exist, there is still a real need for an exercise device for the development of the hands, wrists, arms, and upper body which combines the features of simplicity and economy, with durability and flexibility of use as an exercise device. For example, many such devices allow for resisted motion in one or two directions only. Others are beneficial only with respect to a limited part of the upper body, such as hands, biceps, or forearms. There are also many exercise devices on the market for development of the legs and lower body which have similar problems.

Additionally, many of these exercise devices are usable in one form, or for one type of exercise only, and are not adaptable to multiple exercises or for specialized and varied uses. For example, persons who are handicapped may not be able to operate many exercise devices which are generally produced for able-bodied persons.

It is therefore a primary object of the present invention to provide an exercise device for development of the body which improves upon or solves the problems in the art.

A further object of the present invention is to provide an exercise device which is uncomplicated in structure and use, yet allows great flexibility in the different types of exercises which can be performed with it, and the different applications it can be put to.

A further object of the invention is to provide an exercise device which is produced by a special method to allow for flexibility of use and durability.

Another object of the invention is to provide an exercise device which is durable in structure and in repeated and long-term use.

Another object of the invention is to provide an exercise device which can be used by persons of all different types, levels of fitness, and physical ability or disability.

These and other features, objects, and advantages of the invention will become more apparent with reference to the accompanying specification and claims.

SUMMARY OF THE INVENTION

The present invention is an exercise device, including the process by which it is made. One embodiment of the invention is produced by positioning and securing flange means to inner ends of oppositely disposed handle members. An elastromeric middle member is then molded over the flanges, connecting the two handle members, and presenting a deformable and twistable part of the unitary device to allow the user to move the handle members for exercise purposes. The elastromeric middle member allows the handle members to be moved towards and away from one another, and to be twisted with respect to the middle member. The middle member provides resistance to such movement and at the same time resiliently returns the handle members to an original position after deformation or twisting, once force to the handle members is relaxed or released.

The molding of the elastromeric middle member over the flange members encapsulates the flange members to provide a secure and non-releasable junction between the middle member and the handle members.

The present invention therefore provides an uncomplicated structure which can be marketed at an economical price for purchasers, and which allows a plurality of different exercise movements for the benefit of the user.

The handle members can include handle grips and can be shaped in many different manners. The device can be beneficially used to develop at least the hands, wrists, arms, and the upper body, including the chest and back and the legs and lower body.

The invention also includes a variety of alternative embodiments. Variations in the handles or gripping members are included within the invention. Also, one end of the device can be secured to another object, so that one-hand or leg exercises can be accomplished. Examples of these alternative embodiments will be further discussed below.

BRIEF DESCRIPTION OF THE DRAWINGS

FIG. 23 depicting a detachable handle with an extension member; FIG. 24 depicting a straight detachable handle; FIG. 25 depicting a "D-shaped" closed end; FIG. 26 depicting a double handle detachable end; FIG. 27 depicting generically a detachable end; FIG. 28 depicting a detachable clamping bracket for clamping upon a rod or other external item; FIG. 29 showing a different embodiment of a clamping member which allows pivoting or swiveling around a pivot post.

DETAILED DESCRIPTION OF THE PREFERRED EMBODIMENT

Figure 1:
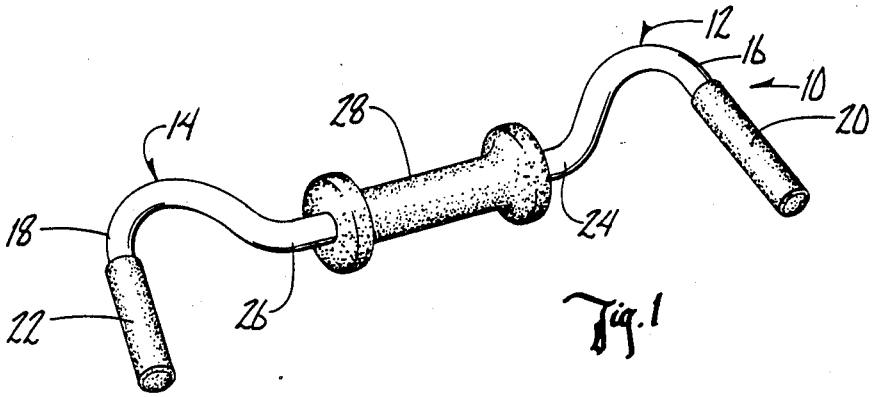
FIG. 1 is a perspective view of one embodiment of the invention.
Figure 2:
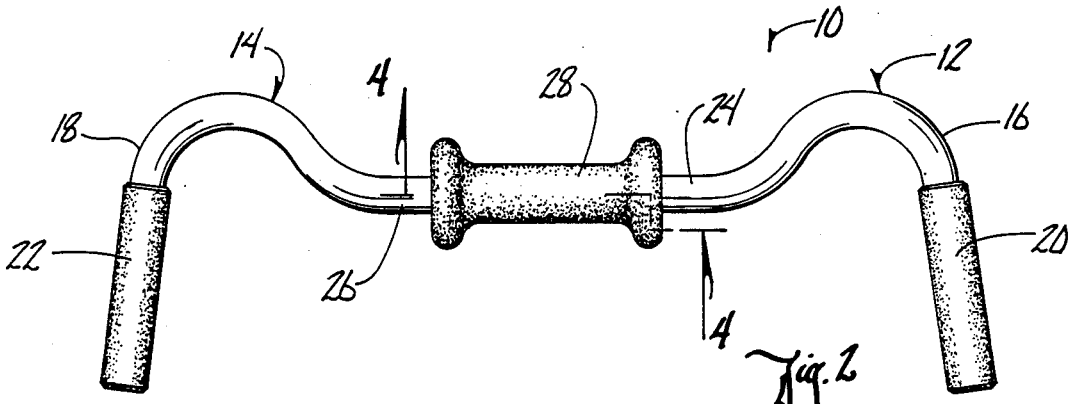
FIG. 2 is a top plan view of the device of FIG. 1.
Figure 3:
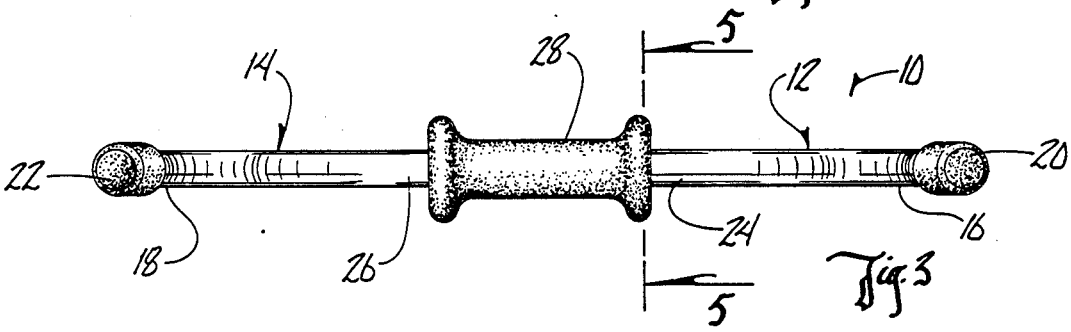
FIG. 3 is a side elevational view of the device of FIG. 1.

With reference to the drawings, and in particular FIGS. 1–3, a preferred embodiment of the present invention can be seen. The exercise device 10 of the invention includes oppositely disposed handle members 12 and 14 having outer portions 16 and 18 which include handle grips 20 and 22. Inner portions 24 and 26 of handle members 12 and 14 terminate into a middle member 28 which is made of an elastromeric material which is deformable and twistable but is resilient.

Figure 4:
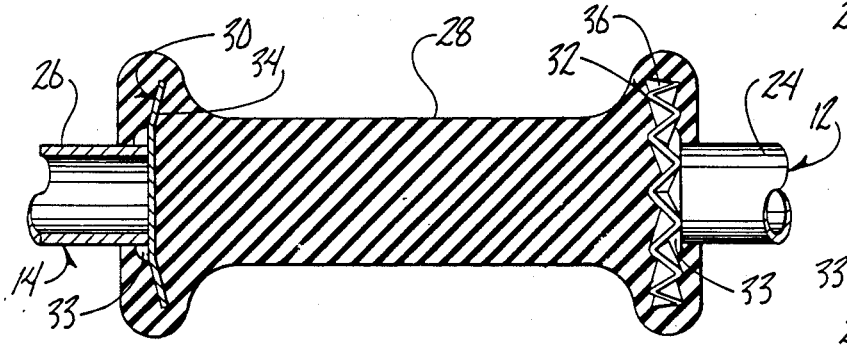
FIG. 4 is a cut-away and sectional view of the middle member of the invention showing two embodiments of encapsulated flanges taken along lines 4—4 of FIG. 2.
Figure 5:
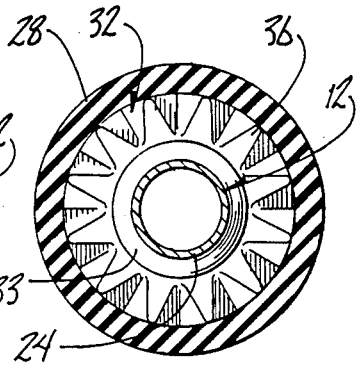
FIG. 5 is a sectional view taken along lines 5—5 of FIG. 3.
Figure 6A:
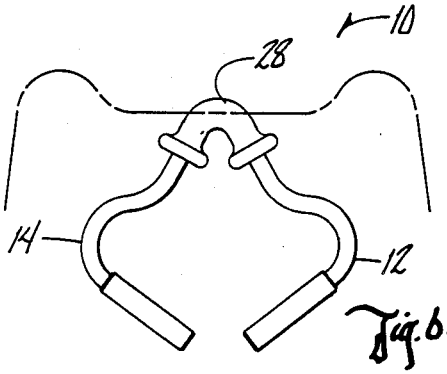
FIGS. 6*a–f* depict a non-inclusive sampling of the various exercise movements which can be accomplished with the device of FIG. 1.
Figure 6B:
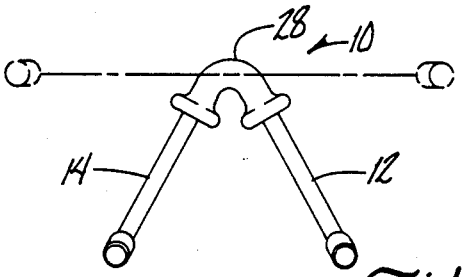
Figure 6C:
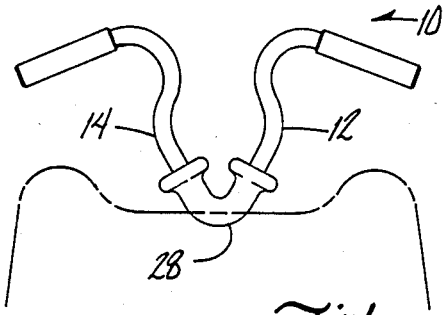
Figure 6D:
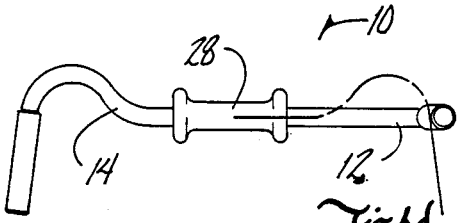
Figure 6E:
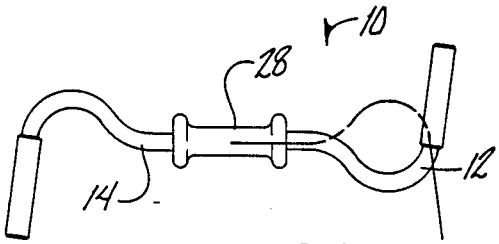
Figure 6F:
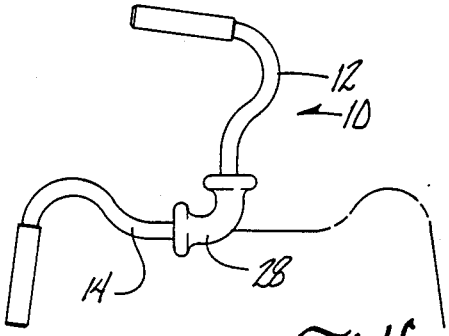

FIGS. 4 and 5 specifically depict the exact manner by which exercise device 10 of FIG. 1 is produced. Flanges 30 and 32 are secured to their respective inner portions 24 and 26 of handle members 12 and 14. This can be accomplished by welds 33 or by other means known within the art. In FIG. 4 two alternative types of flanges are shown. It is to be understood that many flange shapes and configurations are possible while still staying within the boundaries of the invention. Generally, the same configuration of flange is used for flanges 30 and 32 in each device 10. Flanges 30 and 32, attached to handle members 12 and 14, are then positioned within a mold which casts middle member 28 around flanges 30 and 32, thereby encapsulating them, as can be more clearly seen in FIGS. 1–3. The molding process is conventional as is known in the art. Flanges 30 and 32, and to some extent inner portions 24 and 26, are thus encapsulated within the elastromeric material of middle member 28. Handle members 12 and 14 are also thus connected together to form the unitary exercise device 10. Handle grips 20 and 22 may or may not be added, as desired and may take many different forms. Additions such as covers 40 can optionally be added to protect the middle member 28 at the point it covers flanges 30 and 32 (see FIG. 7(*g*)).

It will be noted that in one embodiment, the flanges can have uneven or corrugated portions 36 around their perimeter such as is shown by flange 32 in FIGS. 4 and 5. These portions 36, in effect, give more surface area and a better surface for adhering and retention in middle member 28 than a flat surface. This is particularly important to resist slippage of handle members 12 and 14 when they are twisted with respect to middle member 28. Other forms and shapes of flanges can be utilized (see, for example, flange 30 with slightly bent edges 34 in FIG. 4), however, and exercise device 10 will still function according to its purpose. Protrusions or added on members could also be associated with flanges 30 and 32 to provide increased gripping when encapsulated by middle member 28.

The elastromeric material of middle member 28 in the preferred embodiment can be any one of a number of polyurethane elastomers, but the invention is not limited to such. Polyurethane elastomeres are available from a variety of sources, including nationally known companies such as Uniroyal, Hexel, or United States Gypsum. This material is used in the preferred embodiment because it is extremely durable, easily moldable, and has high resiliency and adhering properties. For example, these materials adhere to metal, which is particularly advantageous, as in the preferred embodiment, flanges 30 and 32 and handle members 12 and 14 are made of metal for strength and durability. The handles can be made of other materials also.

FIGS. 6(*a*)–(*f*) illustrate merely a sampling of the infinite number of various exercise movements which can be accomplished with device 10. In each FIG., the original undeformed position of device 10 is illustrated in ghost lines. FIGS. 6(*a*)–(*c*) illustrate how handle members 12 and 14 can be moved towards one another, thereby deforming middle portion 28. On the other hand, FIGS. 6(*d*) and (*e*) show how handle members 12 and 14 can be twisted with respect to middle member 28, thereby twisting middle member 28. FIG. 6(*f*) shows a combination of moving handle members 12 and 14 towards one another, while at the same time twisting them with respect to middle member 28.

The motions shown in FIGS. 6(*a*)–(*f*) are examples only, and innumerable other movements can be accomplished with device 10. Furthermore, conventionally, the user would grip handle grips 20 and 22 and perform the exercising movements with device 10 in front of the user. However, the user's hands can be crossed to opposite handle grips 20 or 22, or the device 10 can be grasped behind the user's head. Numerous other and varying uses can be performed.

FIGS. 7(*a*)–(*e*) depict alternative embodiments for the shape of handle members 12 and 14. FIG. 7(*f*) is a side view of the handle shape of FIG. 7(*e*). Again, this is only a mere sampling of the handle shape designs and any innumerable number of shapes are possible.

FIG. 7(*g*) shows the handle configuration for the device 10 as shown in FIGS. 1–6. A hand retainer member 41 can be optionally mounted to the ends of portions 12 and 14 of the device 10 to assist in retaining the user's hands to the device 10. Retainer members 41 are rotatably secured to the ends of device 10 and can be rotated 360° thereto. Likewise, a padded covering 42 can be mounted on retainer members 41 to pad them against the user's hands. Retainer members 41 can be removeably installed or removed by means known within the art to allow quick and easy attachment or detachment, according to desire. Retainer members 41 are particularly advantageous for use with persons who have strength in their arms sufficient to use device 10, but do not have strength or functioning sufficiently in their hands to adequately grip handles 20 and 22 of the device 10. Examples of such persons are arthritis patients or stroke patients who can move their arms but not their fingers. By having retainer members 41 their fingers can be put through and they can build up their arms with the exercising possible with device 10.

Figure 8A:
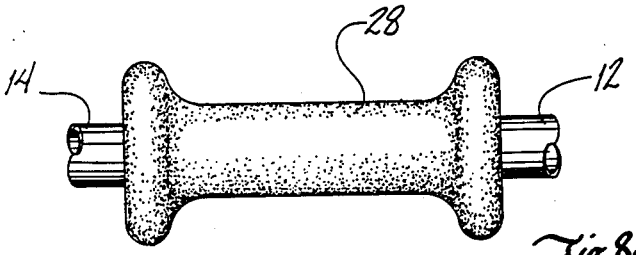
FIGS. 8*a* and 8*b* depict examples of alternative thicknesses of the middle member for the invention.
Figure 8B:
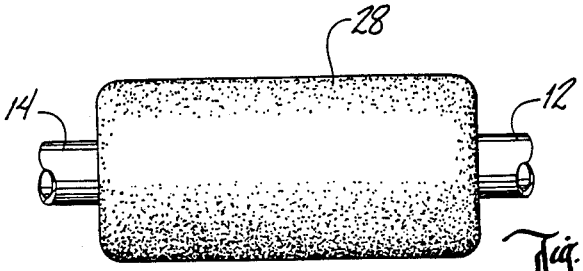

FIGS. 8(*a*) and (*b*) illustrate by two examples that the thickness or diameter of middle member 28 can be varied according to choice between relatively thin and less than the diameter of flange members 30 and 32, as shown in FIG. 8*a*, to a much thicker diameter (FIG. 8(*b*), where its diameter is about equal to the diameter of flanges 30 and 32. Generally, the thickness of middle member 28 will determine its resistance to movement. Therefore, each device 10 can be designed to have a specific resistance, and therefore a specific exercise benefit. There is no limitation to the shape of middle member 28.

Figure 7A:
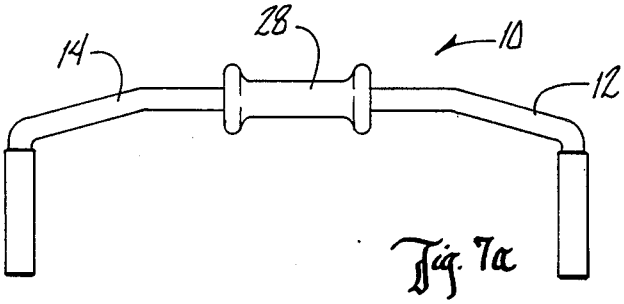
FIGS. 7*a–g* depict a non-inclusive sampling of the different handle shapes which can be used with the device of FIG. 1.
Figure 7B:
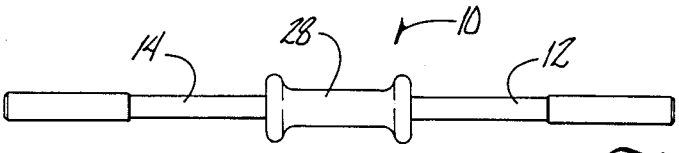
Figure 7C:
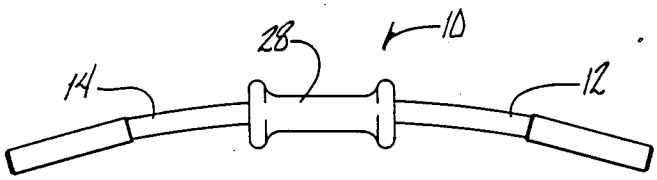
Figure 7D:
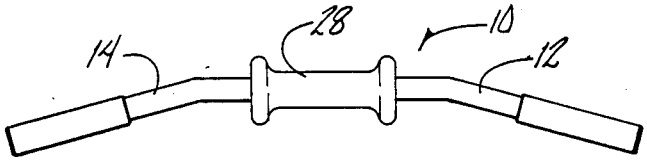
Figure 7E:
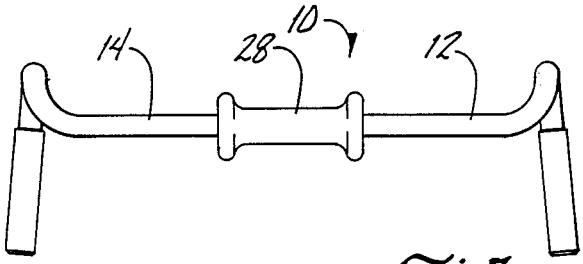
Figure 7F:
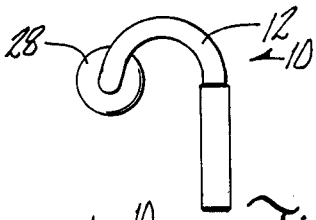
Figure 7G:
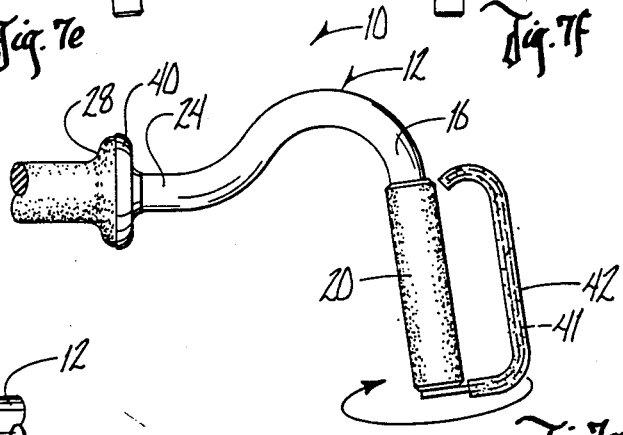
Figure 9:
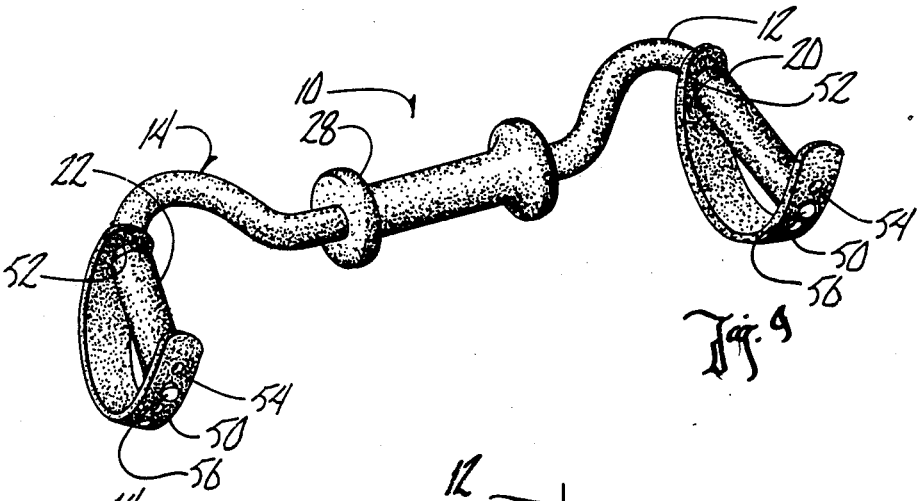
FIG. 9 is perspective view of another embodiment of the exercise device including adjustable hand-retaining straps.

FIG. 9 depicts an alternative to the retainers 41 of FIG. 7G, to allow a user to basically secure his or her hands to the gripping portions of the exercise device 10. FIG. 9 shows identical hand retaining straps 50 which in a preferred embodiment are made of an elastomeric material having apertures 52 in a first end which slide up upon the handles of exercise device 10 to a point above gripping portions 20 and 22, and are held in place by the gripping portions 20 and 22. Straps 50 then hang downwardly and extend back to where a second end has a plurality of adjustment apertures 54 aligned along the longitudinal axis of the strap 50. Attachment posts 56 are secured to the outer ends of handle members 12 and 14 and extend outwardly therefrom. Straps 50 are then positioned and pulled over attachment posts 56 to be secured to exercise device 10, as is shown in FIG. 9. By selecting the appropriate adjustment aperture 54, the tightness or slackness of straps 50 for the user's hands can be adjusted, for the user's hand size and comfort.

Figure 10:
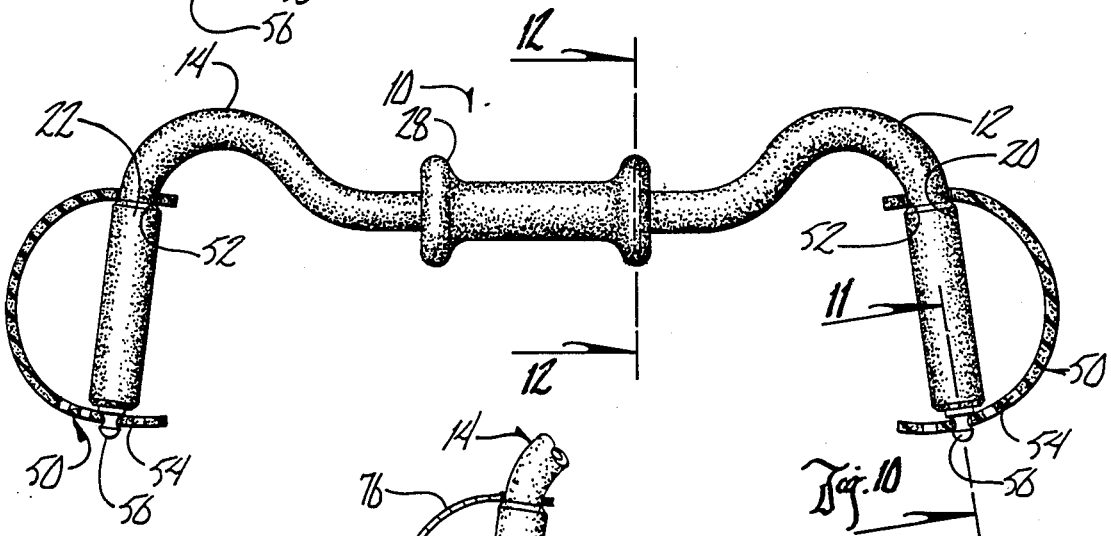
FIG. 10 is a top view of the device of FIG. 9.
Figure 11:
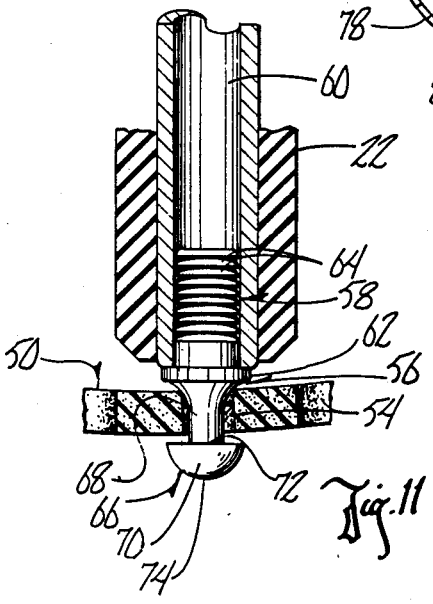
FIG. 11 is a partial sectional view taken along lines 11—11 of FIG. 10.

FIG. 10 shows in more detail the positioning of straps 50 upon exercise device 10. FIG. 11 shows, in enlarged detail, one embodiment for attachment post 56. A first end 58 can be sized to frictionally fit within the hollow interior of each outer end of handle members 12 and 14. A flange 62 can be formed generally in the middle of posts 56 to serve as a stop point when inserting post 56 into hollow interior 60. In the preferred embodiment, post 56 can be made of a rigid but somewhat elastomeric material, and first end 58 can contain multiple ribs 64 to facilitate easy insertion yet increased resistance to removal. Ribs 64 are somewhat sloped towards flange 60.

Second end 66 of post 56 can consist of an outwardly extending neck 68, terminating in a larger diameter head 70. Because straps 50 are elastomeric, head 70 is larger than adjustment apertures 54, which allow head 70 to pass through when forced over head 70. However, flat inner surface of head 70, as opposed to the round outer surface 74, resists, to a greater degree, removal of strap 50 from post 56. It is to be understood, however, that head 70 in neck 68 should be sized accordingly so that adjustment of strap 50 from adjustment aperture to adjustment aperture 54 is not difficult.

Figure 10A:
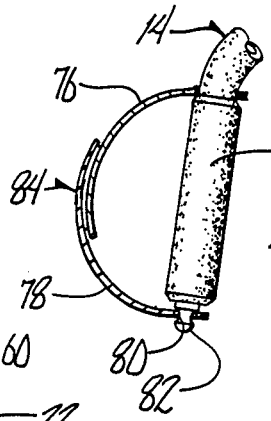
FIG. 10A is a partial top view of an alternative hand-retaining strap.

FIG. 10A shows an alternative embodiment for hand-retaining straps. A first strap is secured to device 10 in front of gripping portion 22, similarly to hand retaining straps 50 of FIG. 9. However, a second strap 78 has one aperture 80 only, and is secured over post 82 at the end of handle member 14. Adjustment is facilitated by a releasable fastening means 84 at the ends of halves 76 and 78 which meet at a spaced-apart position from gripping portion 22. In the preferred embodiment, releasable fastening means 84 can be male and female Velcro portions, such as are known in the art.

Figure 12:
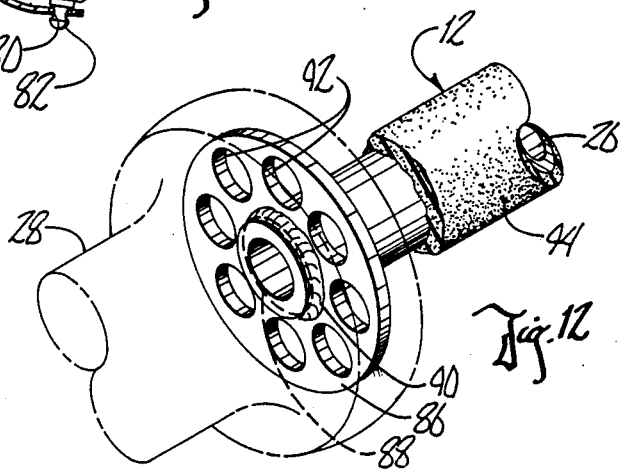
FIG. 12 is a partial perspective isolated view of an alternative flange or washer which is encapsulated by the elastomeric middle section which is depicted in ghost lines. This figure is taken generally along lines 12—12 of FIG. 10.

FIG. 12 depicts an alternative and preferred embodiment for the junction between the handles of the exercise device and the middle elastomeric member. A washer 86 having a middle aperture 88 is secured over the very end of inner ends 24 and 26 of handles 12 and 14 of exercise device 10, by welding 90. Washer 86 has a plurality of flow apertures 92 generally evenly spaced radially around middle aperture 88. Washer 86, in the preferred embodiment, is generally flat with a circular perimeter. Middle elastomeric member 28 is then formed so as to encapsulate washer 86, and also have integral portions extending through flow apertures 92. In the preferred embodiment, elastomeric middle member 28 is molded so that portions of it flow through flow apertures 92 and harden in that position. Washer 86 would therefore not only be encapsulated by the elastomeric member, but portions of the elastomeric member would fill in and bridge through flow apertures 92.

The advantage of washer 86 is that it still prohibits lateral separation of washer 86 from middle member 28, and at the same time, provides increased resistance to rotation of middle member 28 with respect to washer 86. Additionally, it resists any gapping or air bubble voids which could contribute to failure of the device.

It is pointed out that FIGS. 9, 10, 10A, and 12 also show that handle members 12 and 14 can include a covering 94 such as plastic or foam rubber, which would assist in lessening the likelihood of exercise device 10 marking or otherwise damaging anything, or alternatively, it can provide an alternate gripping surface for the exercise device.

Figure 13:
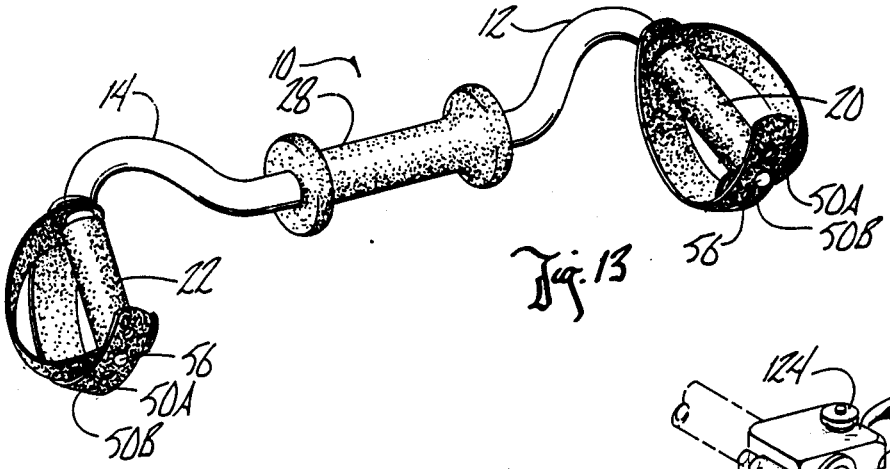
FIG. 13 is a perspective view showing a still further embodiment of hand-retaining straps.

FIG. 13 depicts a still further embodiment for retaining a user's hands to the exercise device. It was discovered that by using two adjustable hand-retaining straps 50 (in FIG. 13 referenced as 50A and 50B), on the end of each handle 12 and 14, an even better and more secure retention of a user's hand could be created. This is particularly important in the case with persons having a physical handicap whereby the person has diminished or little gripping strength. Both straps 50A and 50B would be adjustable as described previously, and elastomeric so that they can be tightened around the user's hand, but do not injure or otherwise present an uncomfortable securement.

Figure 14:
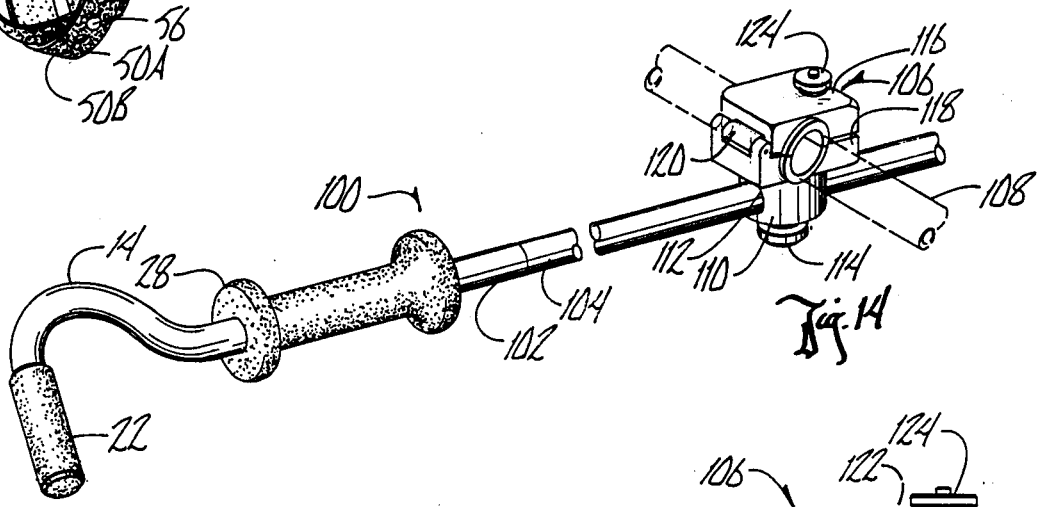
FIG. 14 depicts an embodiment of the exercise device where one handle comprises a clamping joint which is attachable to an object such as a bar or pole.

FIG. 14 depicts a still further embodiment for the present invention, whereby exercise device 100 includes a middle elastomeric member 28 and handle member 14 the same or similar to that shown in FIG. 1, but opposite from handle 14 includes an attachment handle 102 extending from middle elastomeric member 28 outwardly to an extension arm 104 which in turn is adjustably positionable in attachment joint/clamp 106. Joint/clamp 106 can be adjustably and removably secured to a fixed member such as bar 108, shown in ghost lines in FIG. 14. This allows the benefits of the exercise device to be enjoyed by persons having only one arm or hand which can grip an exercise device, or to persons disabled and requiring the exercise device to be supported.

Attachment joint/clamp 106, in the preferred embodiment, includes selectively rotatable receiving member 110 having an aperture 112 which receives extension arm 104. A securing screw 114 is then threadably movable into and out of engagement with extension arm 104 when it is within aperture 112 by means of a threaded aperture which is oriented angularly with respect to aperture 112. Extension arm 104 can then be inserted and securely adjusted longitudinally in aperture 112.

Receiving member 110 can be rotatable with respect to clamp jaws 116 and 118; or it can be stationary and immovably secured to lower clamp jaw 118. In either respect, clamp jaws 116 and 118 are hingeable with respect to each other by hinge 120 which is positioned along the edges of jaws 116 and 118 parallel to the longitudinal axis of bore 122 which is formed when jaws 116 and 118 are adjacent or in abutment to one another, as shown in FIG. 14. A securing screw 124 is threadably movable within a threaded aperture in top jaw 116 and is disposed angularly to bore 122. Jaws 116 and 118 can therefore be opened and then closed around an object such as bar 108 so that it is cradled in bore 122, and then securing screw 124 can be turned down through threaded bore in jaw 116 until it is received by a threaded bore in lower jaw 118, thereby securing the jaws together, and securing joint/clamp 106 to bar 108.

Figure 15:
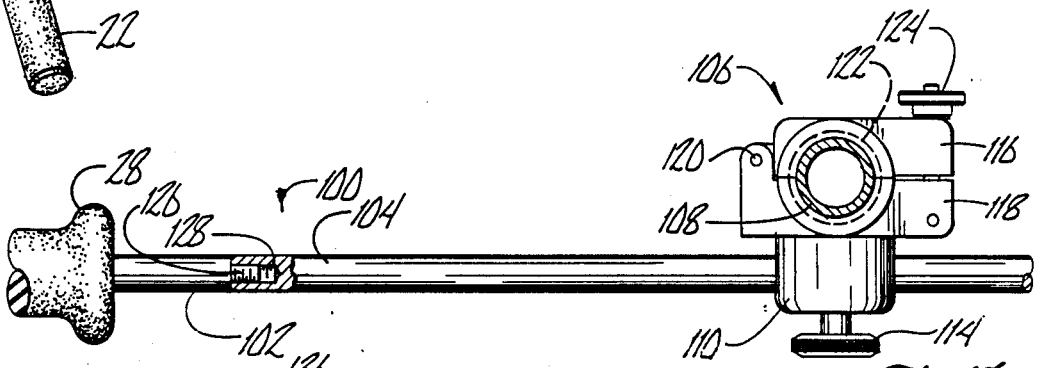
FIG. 15 is a side view and partial exposed view of the clamping joint and arm of FIG. 14.

FIG. 15 shows one embodiment of attachment of attachment handle 102 of exercise device 100 to extension arm 104. A threaded stud 126 can extend outwardly along the longitudinal axis of attachment handle 102. Accordingly, stud 126 is received by threaded bore 128 in the adjacent end of extension arm 104. Such an arrangement would be secure and allow attachment of exercise device 100 to a doorway exercise bar, a wheel chair, a walking rail, a hospital bed rail, and any similar object. It is to be understood that joint/clamp 106 can be of various configurations, allowing it to be attached to square bars, and other shaped and configured objects. Indeed, joint/clamp 106 can take on many forms to allow any type of attachment to a fixed or secured object.

Figure 16:
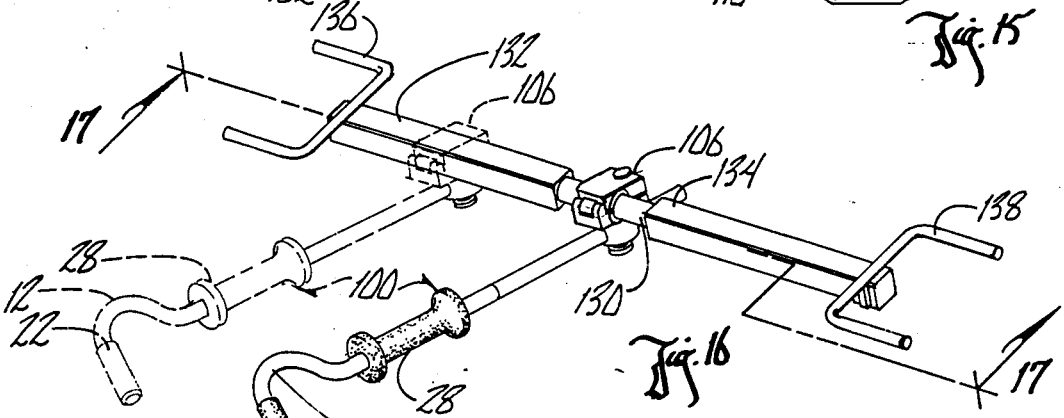
FIG. 16 is a perspective view of the exercise device of FIG. 14 attached to a doorway bar mechanism.

FIG. 16 shows one type of doorway bar which allows use of exercise device 100 conveniently with a doorway exercise bar. The center round bar 130 is disposed between square expansion bars 132 and 134 on either side of center round bar 130. At the outer end of each expansion bar 132 and 134 are hingeable U-shaped brackets 136 and 138.

To install this door bar, expansion bars 132 and 134 are adjusted inwardly on center round bar 130 so that their combined length is less than the horizontal distance between the side jambs of the door frame. Additionally, U-shaped brackets 136 and 138 are hinged upwardly so that they are interiorly positioned to the outer ends of expansion bars 132 and 134. The bar is then approximately positioned between side jambs of the door frame, and the U-shaped brackets 136 and 138 are hinged downwardly to their position in FIGS. 16 and 17 so that the outward parallel arms of brackets 136 and 138 cradle the side jambs.

Figure 17:
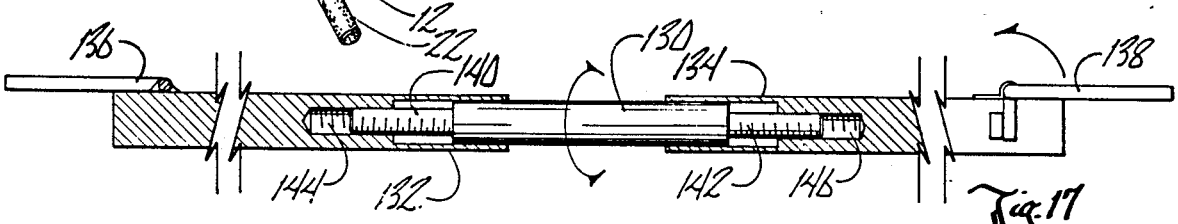
FIG. 17 is a partial sectional view taken along lines 17—17 of FIG. 16.

As shown in FIG. 17, in the preferred embodiment, center round bar 130 has threaded studs extending from its opposite ends which threadably mate with threaded bores 144 and 146 in expansion bars 132 and 134. The threads on each side of center round bar 130 are opposite one another so that rotation of center round bar 130 causes expansion bars 132 and 134 to either simultaneously move apart, or simultaneously move towards one another. Thus, by rotation of round bar 130, the expansion bars 132 and 134 can be extended to abut and forcibly fit between side jambs of the door frame. The bar would therefore be secured in position in the door frame and exercise device 100 could then be attached thereto for use.

Exercise device 100 is preferred to be attached to expansion bars 132 or 134, , but as shown in FIG. 17, could also be attached to round bar 130.

Figure 18:
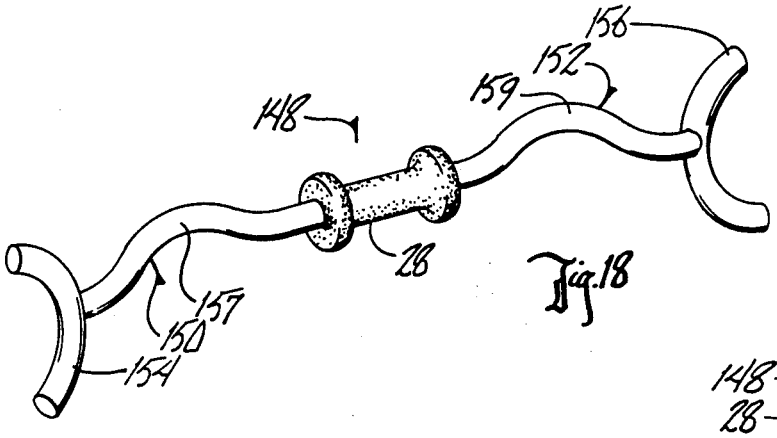
FIG. 18 is a perspective view of an embodiment which can be used for exercising the legs and thighs.
Figure 19:
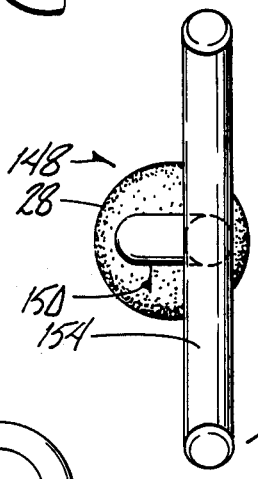
FIG. 19 is an end view of the embodiment of FIG. 18.

FIG. 18 shows a still further alternative embodiment in the invention. Exercise device 148 can be comprised of middle elastomeric member 28, but instead of hand gripping handles, can have identical leg exercise handles 150 and 152 extending from opposite sides of middle member 28. At the end of each leg exercise handle 150 and 152 are concave shaped receiving members 154 and 156 which can be used by placing against a person's thighs or calves and then moving the legs inwardly to cause flexing and bending of middle member 28, which at the same time exercises the legs. The bends 157 and 159 in handles 150 and 152 offset receiving members 154 and 156 from the longitudinal axis of middle member 28 allowing inward converging movement of the legs to cause bending of middle member 28, as is shown more clearly in FIG. 19.

Exercise device 148 can also be used in other ways to advantageous exercise effect. It is again to be understood that many different types and configurations of handles attached to middle elastomeric member 28 can be used for different exercise effects.

For example, middle member 28 could be made from other elastromeric materials having the same or similar properties. For example, natural or synthetic rubber could be used. It is to be understood that any number of types and kinds of elastomers may be adaptable for use with the invention. As discussed above, handle shapes and thicknesses of middle member 28 can be varied according to desire.

For further example, it is to be understood that different types of handles and ends can be utilized with elastomeric middle mmber 28. In one alternative, the exercise device could have removable gripping portions on each side of middle member 28 which could have a variety of attachments for flexible exercise use. The user could either attach hand gripping handles, with or without retaining straps, and then could change one handle so that it could be substituted with a clamp means for use with a doorway bar or hospital bed. It is also to be understood that there is no limitation as to how the exercise device can be used. For example, even with the hand gripping handles attached, the user could place one handle on the floor, and then press his or her foot on the gripping portion of the handle and exercise the arm by gripping the other handle with the user's hand. The exercise device, in its many embodiments, is extremely versatile and adaptable for various needs and uses.

The handles of the exercise device could also be made of a variety of materials, including but not limited to, metals such as steel and aluminum, or plastics.

Figure 20:
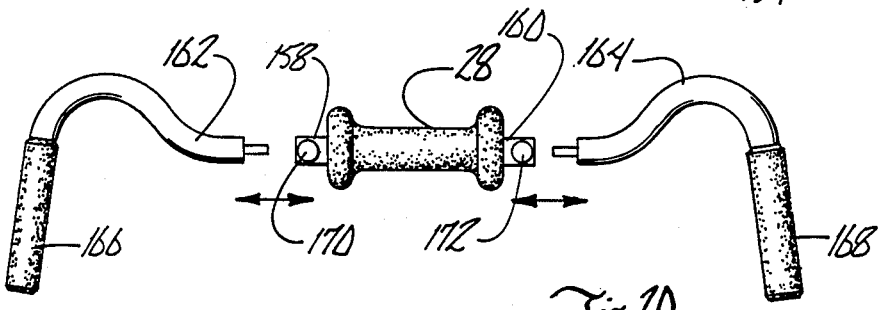
FIG. 20 is a plan view of a still further embodiment showing detachable handles.

A sampling of specific examples of alternatives for the invention will now be described. It is to be understood that these are set forth by way of example only, and are not inclusive. FIG. 20 shows an alternative embodiment of the invention with a middle elastomeric member 28. Instead of having handles directly attached to the flange members encapsulated in middle member 28, attachment ends 158 and 160 are rigidly secured to the flanges encapsulated in middle member 28 and serve to receive attachments in a securing manner thereto. In FIG. 20, the attachments are detachable handles 162 and 164 with gripping portions 166 and 168. When assembled, and locking members 170 and 172 are locked, the embodiment of FIG. 20 essentially is the same as that shown in FIG. 1.

Figure 21:
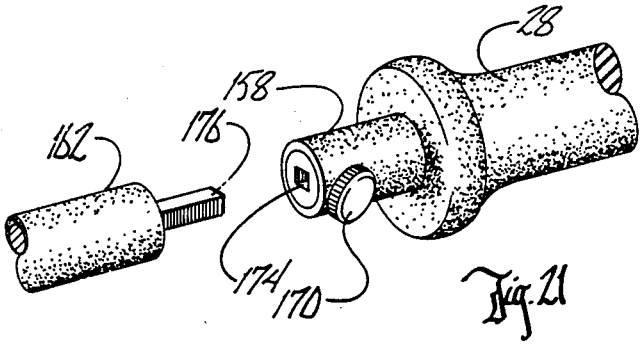
FIG. 21 is a partial perspective view of one means by which detachable elements can be secured to the middle portion of the embodiment of FIG. 20.

FIG. 21 shows one embodiment of the attachment end and the manner in which it secures attachments. Attachment end 158 includes a receiving bore 174 which extends inwardly generally along the longitudinal axis of end 158. Locking member 170 consists of a threaded screw which is threadably movable through a threaded bore (not shown) lateral to receiving bore 174. The inner end of locking member 170, when fully screwed in, enters receiving bore 174. Any attachment, such as handle 162, includes an insertion member 176 which slidingly but in generally closely conforming dimensions, is insertable into receiving bore 174 when locking member 170 is moved out of receiving bore 174. Locking member 170 would then be screwed in until it abuts and frictionally holds insertion member 176 in receiving bore 174 to secure handle 162 to attachment end 158. It is to be understood that the shape of receiving bore 174 and insertion member 176 should be closely conforming, but it is preferred that they be rectangular which disallows any relative pivoting around the longitudinal axis of these elements, but does allow the handle to be oriented in at least four different ways to attachment end.

Figure 22:
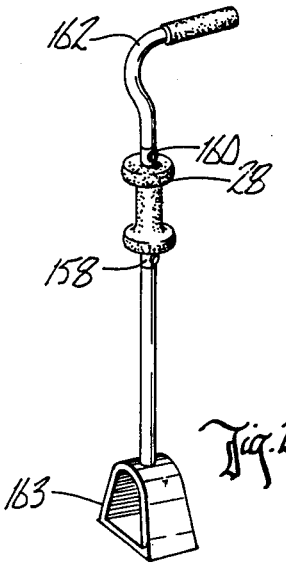
FIG. 22 shows the embodiment of FIG. 20 with one handle attachment being comprised of a loop end whereby a user's foot or other stabilizing item can be inserted and the other handle end can be used for exercising.
Figure 23:
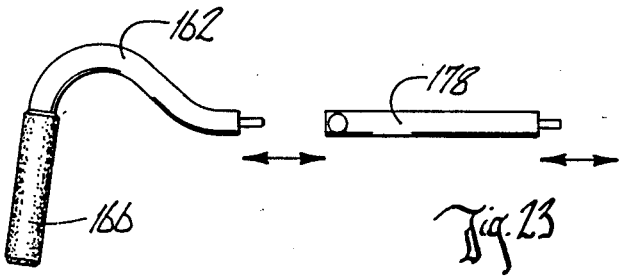
FIGS. 23–29 depict a few examples of different detachable attachments to the middle member of FIG. 20.

It is to be therefore understood that a variety of different attachments can be utilized to either attachment end 158 or 160 of the middle elastomeric member 28 of the embodiment of FIG. 20. FIG. 22 depicts a hand-gripping handle 162 connected to one end of middle member 28, and a foot holder 163 so hand and/or foot can be exercised. For further example, in FIG. 23, one or more extension members 178 can be inserted between an attachment such as handle 162, and attachment end 158, by the same method described with regard to FIG. 21.

Figure 24:
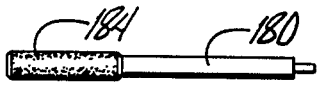
Figure 25:
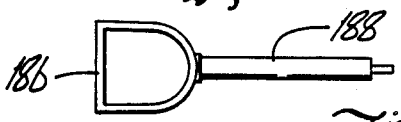
Figure 26:
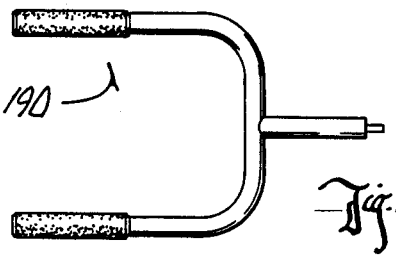
Figure 27:
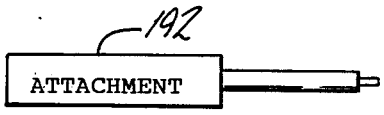

FIGS. 24–27 simply depict but a few different attachment configurations such as a straight handle 182 with gripping portion 184 in FIG. 24; a D-shaped portion 186 with straight handle 188 in FIG. 25; a double handle 190 in FIG. 26; all of which can be used for various functions. FIG. 27 shows what will be called a generic attachment 192 to emphasize the fact that numerous types of attachments can be used with the device.

Figure 28:
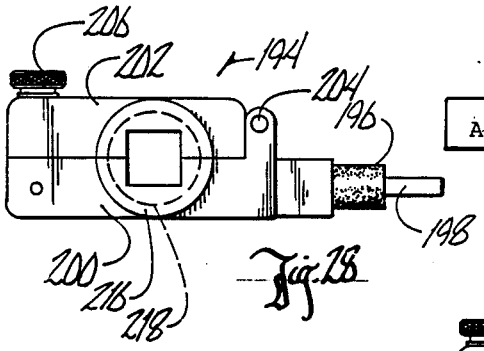

Not only can the attachments consist of handles for exercise, FIG. 28 depicts a clamp member 194 having an arm 196 with an insertion member 198 which can be secured to attachment end 158 or 160 of middle elastomeric member 28 in FIG. 20. The clamping member 194 is similar to that shown and discussed with respect to FIGS. 14–16 except that arm 196 is rigidly and securely attached directly to a base 200. A top member 202 is pivotable with respect to base 200 around pivot pin 204. A locking member 206, consisting of a screw that extends through a threadable bore into a threadable bore in base 200 locks the pivotable top member 202 to the base 200. This attachment can therefore be used to attach one side of the elastomeric middle member 28 to an external object such as an exercise bar, a hospital bed, a railing, or something else. It therefore provides an easy way to secure one side of the exercise device and allows an exercise handle to extend from the other side, particularly in cases of handicapped or disabled persons.

Figure 29:
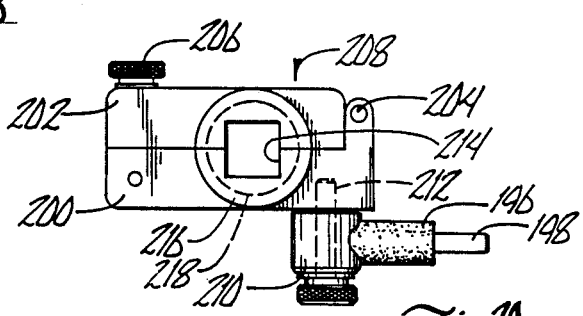

FIG. 29 shows alternative clamping member 208 which is exactly the same as clamp member 194 except that arm 196 is attached to a rotatable member 210 which is rotatable about a pivot pin 212 which is secured to base 200. This allows attachment of middle elastomeric member 28 to arm 196, but allows pivoting of the exercise device with respect to the external item to which the clamping member 208 would be secured. Thus, for example, in a hospital bed, the patient could incrase the range of exercise motions advantageously used by pivoting the exercise device between different positions for each exercise. It can be seen in FIG. 29 that a square aperture 214 exists through an insert member 216 that is positioned within a round channel 218 through the clamping member 208. A rectangular bar or bed rail (not shown) can be clamped around square aperture 214.

Figure 30:
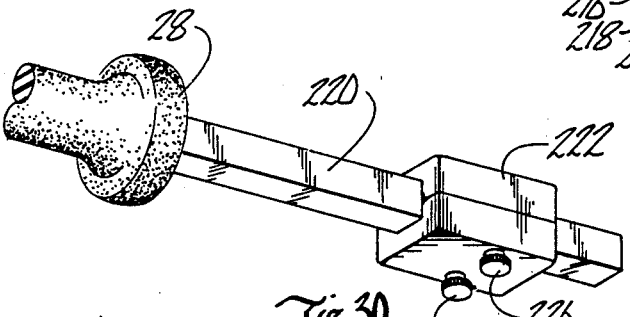
FIG. 30 depicts an alternative embodiment of the invention whereby a square bar extends from the middle member and has an adjustable connection means positioned upon it.

FIG. 30 shows another embodiment for the invention. A square or rectangular arm 220 can be directly secured to the flange member encapsulated by elastomeric middle member 28, and extend outwardly therefrom. An adjustable attachment or connection member 222 having locking members 224 and 226 can be adjustably secured along the length of square arm 220, and in turn have some means for being secured to either some type of an exercise handle, or some external object. Adjustable attachment member 222 could be in the same form as either clamp member 194 or clamping member 208, or have some other configuration.

Figure 31:
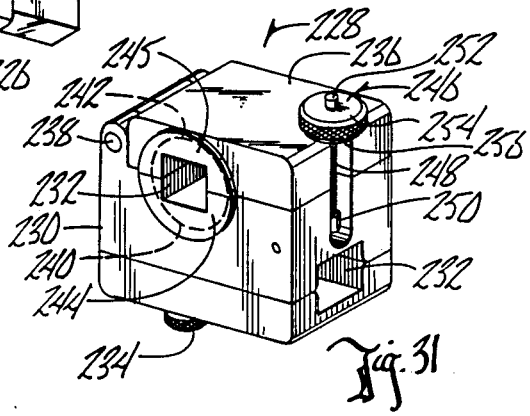
FIG. 31 depicts in more detail an adjustable attachment means which can be used to attach an embodiment of the invention to an external bar or item.

FIG. 31 shows one embodiment of a clamping member 228 which can be inserted upon the square arm 220 of the embodiment of the exercise device shown in FIG. 30. A base 230 has a square aperture 232 which receives in closely conforming fashion, a square arm 220. A locking screw 234 threadably extends through base 230 into square aperture 232 and serves to lock square arm 220 in a desired position. Pivotable top 236 pivots around pivot pin 238 with respect to base 230. Base 230 and top 236 have corresponding semi-circular in cross-section channels 240 and 242 into which are removably positioned semi-circular inserts 244 and 245, respectively. Top 236 is adjustably brought into clamping abutment with base 230 and secured thereby securing mechanism 246, which includes a rod 248 being pivotally secured at a pivot end 250 to base 230, and having an opposite threaded end 252 upon which exists a threadably adjustable locking member 254. Locking member 254 has a high friction underside, which in the preferred embodiment is a rubber (or similar material) washer 256. To secure top 236 to base 230, locking member 254 is threadably moved close to the top of rod 248, rod 248 is moved to the position shown in FIG. 31, and then locking member 254 is turned down upon top 236. Rubber washer 256 holds securing mechanism 246 in position and secures top 236 against base 230. To release top 236, locking member 254 is threaded upwardly, rod 248 is swung down, and top 236 can then be pivoted upwardly to gain access to either the inserts 244 and 245, or to release the clamping member 228 from any bar or hospital bed to which it is secured. Clamping member 228 therefore presents an easy method to clamp the exercise device to an external item which is easy to operate, and yet very reliable in its clamping action, so that it can be easily operated by the exerciser, even if somewhat handicapped or disabled.

As can be seen in FIG. 31, semi-circular inserts 244 and 245 seat within semi-circular channels 240 and 242 in base 230, and top 236, respectively.

Figure 32:
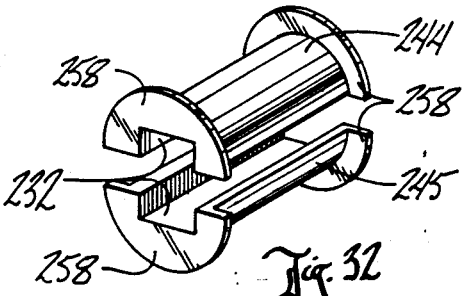
FIGS. 32 and 33 are isolated and exploded perspective views of inserts into the means of FIG. 31.
Figure 33:
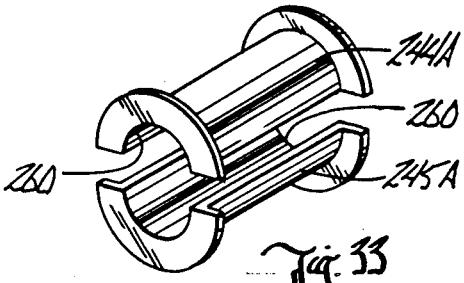

FIGS. 32 and 33 show two alternative embodiments for inserts 244 and 245. FIG. 32 shows inserts 244 and 245 as they are in FIG. 31, and how they have flanges 258 at their ends to guide them into place in clamping member 228. Inserts 244A and 245A of FIG. 33 are identical except that when positioned in place in clamping member 228, they form a circular apertured 260. It can therefore be seen that the inserts can control the size and shape of any type of bar or external item to which clamping member 228 can be attached.

Figure 34:
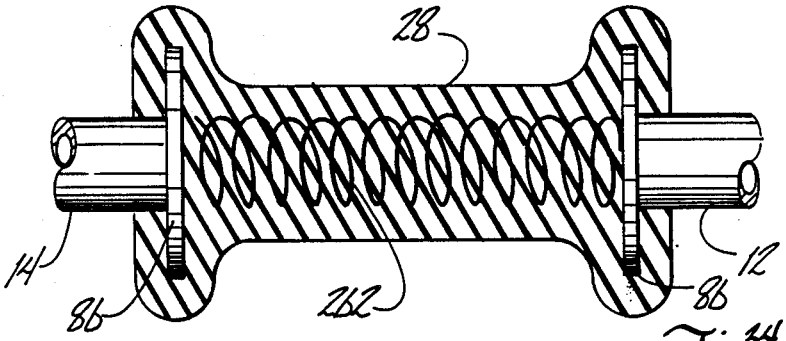
FIG. 34 is an alternative embodiment of the present invention showing in cross-section a middle elastomeric member encapsulating flange means which are secured to outwardly extending arms, and including a spring means disposed longitudinally through the elastomeric member either attached or non-attached to the flanges.

FIG. 34 shows an alternative embodiment of the invention with respect to the interior of elastomeric middle section 28. In order to provide a change of effect regarding the bending resistance and resiliency of middle member 28, a spring 262 can be encapsulated into middle member 28 between opposite ends of middle member 28. The strength and resiliency of spring 262 can alter the properties of middle member 28 according to design choice. It can be used in middle member 28 regardless of the attachments extending from middle member 28. Spring can be attached to one or both handles (or flanges), or be unattached.

Figure 35:
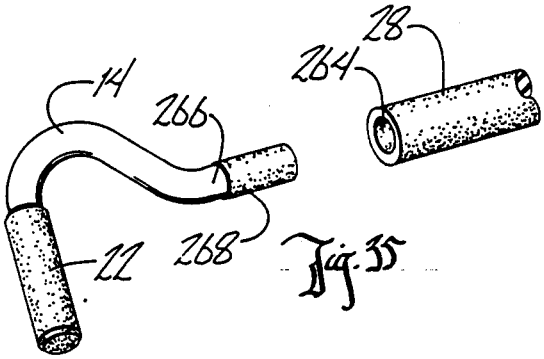
FIG. 35 is a partial perspective view depicting an alternative means and method for attaching any handle to the middle elastomeric member.

FIG. 35 shows that as an alternative embodiment, elastomeric middle section 28 can include apertures 264 at opposite ends into which can be inserted the attachment end 266 of a handle 14. Attachment end 266 would include a bonding substance 268 which would bond the attachment 266 of handle 14 to middle member 28, and thus secure handle 14 to middle member 28 so that it can accomplish all the exercise movements previously described without requiring a flange means at the end of handle 14. It is to be understood that bonding substance 268 can be any type of glue or bonding substance which reacts and cooperates with the material of elastomeric middle section 28 to form such a secure junction. In a preferred embodiment, if middle section 28 is made out of polyurethane, an acceptable bonding substance 268 could be used. The term "bonding substance" is used here to include any type of coating or substance which could enhance or add to the junction between an arm (metal, plastic, or otherwise) and the middle elastomeric member. It could include glue, adhesives, or other substances. It also could include substances which present a better surface for bonding to polyurethane or urethane, or any material the middle member is made of; or substances which etch or roughen a surface to enhance such bonding. Other combinations which achieve the objects of the invention could also be used.

Figure 36:
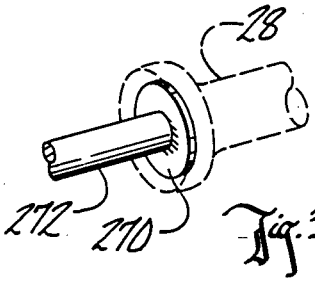
FIG. 36 is a partial perspective view depicting an alternative embodiment whereby the flange is made of a different material than the arm extending outwardly from it.

FIG. 36 depicts an exercise device according to the invention having an elastomeric middle section 28 which encapsulates a flange 270 which in turn is secured to an arm 272 extending outwardly therefrom. It is to be understood that flange 270 or arm 272 can be made from different substances. For example, flange 270 could be made of a paper or plastic substance, whereas, arm 272 could be made out of metal, a harder or more rigid plastic or rubber or some other substance. Flange 270 could be attached to arm 272 by means known within the art including glue, or some other means.

Figure 37:
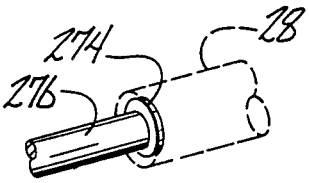
FIG. 37 is a partial perspective view depicting an alternative embodiment with a flange of only slightly greater diameter than the diameter of the handle extending from it.

FIG. 37 shows that flange 274 attached to arm 276 could be encapsulated by middle section 28, wherein flange 274 is of only slightly greater outside diameter than arm 276. Again, the materials of flange 274 could be different than that of arm 276.

Figure 38:
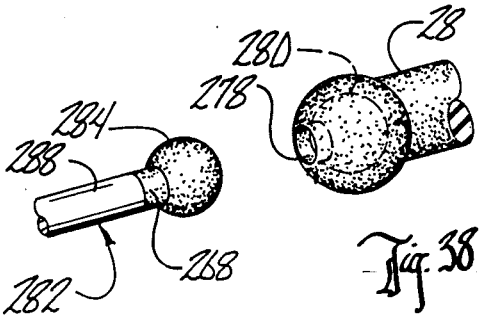
FIG. 38 shows in partial perspective view an alternative embodiment of the invention showing the handle member disassembled from the middle elastomeric member.

FIG. 38 shows an elastomeric middle section 28 which includes an aperture 278 in its end which extends inwardly to a greater diameter inner cavity 280. Arm 282 includes a rounded end 284 which may or may not be coated with bonding substance 268. It is to be understood that aperture 278 is smaller than the outside diameter of rounded end 284, and in fact is smaller than the outside diameter of shaft 288 of arm 282. Additionally, inner cavity 280 is smaller in diameter than rounded end 284. The elastomeric nature of middle member 28 allows insertion of rounded end 284 and a portion of shaft 288 into aperture 278 and inner cavity 280, and the resiliency of middle member 28 causes forceful and frictional securement of arm 288 in middle member 28 in that manner. Bonding substances 268, if used, would contribute to the securement.

Figure 39:
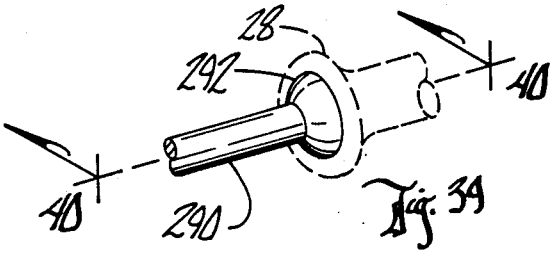
FIG. 39 shows a still further embodiment of a means and method for securing the handles to the middle elastomeric member.
Figure 40:
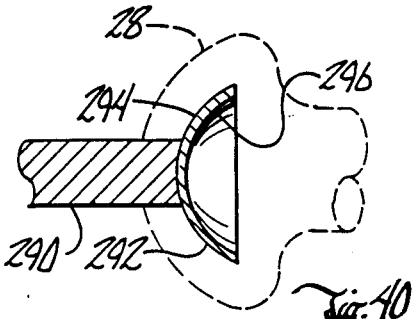
FIG. 40 is a sectional view taken along lines 40—40 of FIG. 39.

FIGS. 39 and 40 show an alternative embodiment for attachment of arm 290 to middle member 28. A cup-shaped end 292 having a convex side 294 facing outwardly of middle member 28, and a concave side 296 facing inwardly of middle member 28, can be encapsulated by middle member 28.

Figure 41:
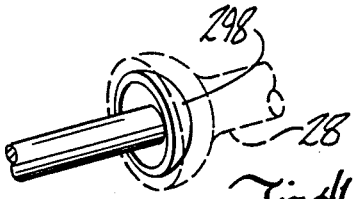
FIG. 41 is a still further alternative embodiment of a different method for attaching the handle to the middle elastomeric member.

FIG. 41 shows a similar cup-shaped end 298, however, the convex and concave sides are reversed.

Figure 42:
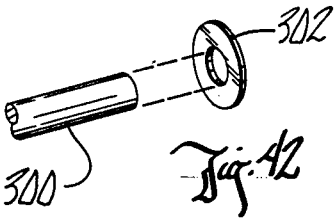
FIGS. 42 and 43 show still further embodiments for attaching a flange to the handle member.
Figure 43:
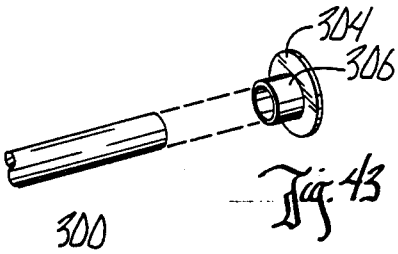

FIGS. 42 and 43 depict, respectively, an arm 300 with a washer flange 302 which can be secured by means known in the art to arm 300 and then in turn encapsulated by middle member 28, or a cap-shaped flange 304 having a tube extension 306 which can secure either inside or outside of arm 300 and then serve as flange over which middle member 28 is molded. Again, arm 300 can be of a different material than flanges 302 or 304.

Figure 44:
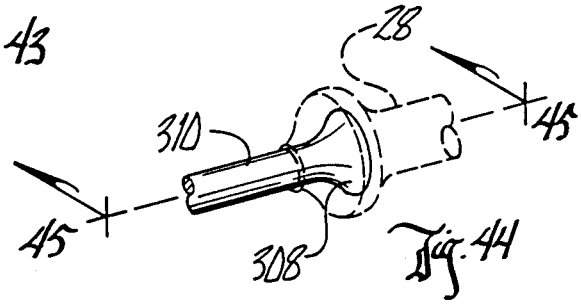
FIG. 44 shows a still further embodiment of a means and method for attaching a handle to the middle elastomeric member.

FIG. 44 depicts a flared or horn shaped flange 308 which is encapsulated by middle member 28 or force fit into member 28. Flange 308 can be formed integrally with arm 310 and either can have middle member 28 molded over it, or can be inserted into an aperture in the end of middle member 28, and then optionally secured with a bonding substance.

Figure 45:
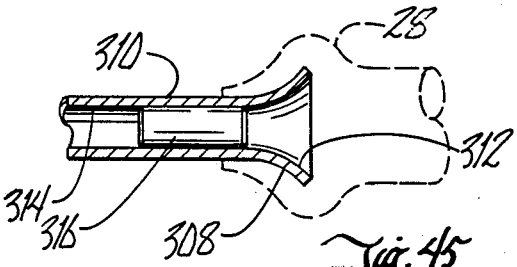
FIG. 45 is a sectional view taken along lines 45—45 of FIG. 44.

FIG. 45 shows that in one embodiment of utilizing horn-shaped flange 308, the end of flange 308 has an opening 312 to the hollow middle 314 of arm 310. In order to prevent molded material of middle member 28 from flowing down into hollow middle 314, a plug 316 can be inserted therein.

Figure 46:
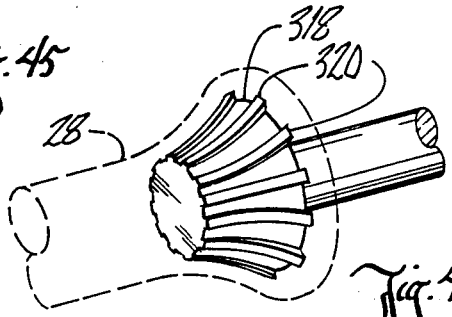
FIG. 46 depicts an alternative embodiment of a means and method for attaching the handle to the middle elastomeric member, including raised rib sections on the portion of the handle encapsulated by the middle elastomeric member.

FIG. 46 depicts a reverse horn shaped flange 318, having its fluted horn shape reversed from that shown in FIGS. 44 and 45. As an alternative option, raised edges 320 can be included which would assist in holding flange 318 in place within middle member 28.

Figure 47:
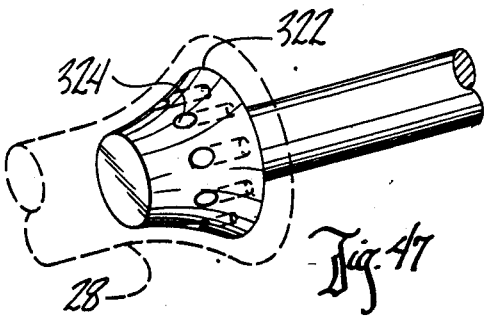
FIG. 47 depicts in perspective alternative embodiment a means and method for attaching the handles to the middle elastomeric member, including apertures in the portion encapsulated to allow the elastomeric material to flow through during molding.

FIG. 47 shows a horn shaped flange 322 similar to that shown in FIG. 46. To further attempt to secure flange 322 within middle member 28, apertures 324 can be positioned around flange 322. When middle member 28 is molded around flange 322, the molded material can flow through and harden between the opposite open ends of apertures 324 which will assist in bonding flange 322 in middle member 28.

Figure 48:
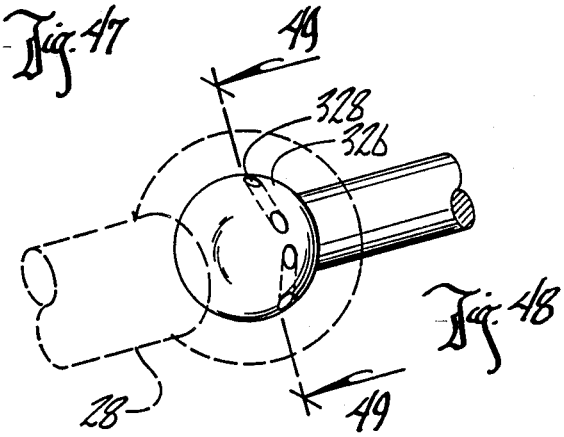
FIG. 48 shows another alternative embodiment of a means and method for attaching the handle to the middle elastomeric member, including apertures like those in the embodiment of FIG. 47.

FIG. 48 shows a rounded flange 326 having apertures 328 which function similarly to that of the embodiment described in FIG. 47.

Figure 49:
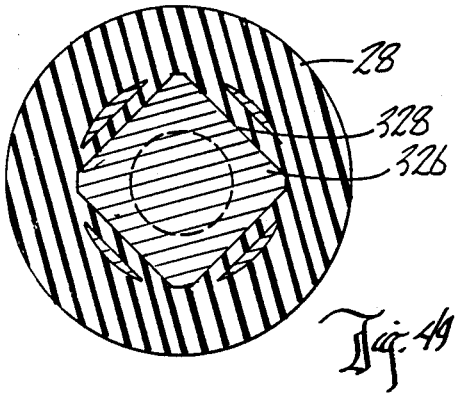
FIG. 49 is a sectional view taken along lines 49—49 of FIG. 48.

FIG. 49 is a cross-sectional view taken along lines 49—49 of FIG. 48 showing how the molded material of middle member 28 has flowed through and between, and hardened into place to assist in the binding process. The included preferred embodiments above are given by way of example only, and not by way of limitation to the invention, which is solely described by the claims herein. Variations obvious to one skilled in the art will be included within the invention defined by the claims.

What is claimed is:

1. An exercise device for development of the body of an exerciser, comprising:

an elastomeric middle member;

first and second oppositely extending arm members, each arm member having a first end encapsulated in opposite ends of the middle member to provide a secure nonreleasable junction between the middle member and the arm members, all surfaces of each first end being encapsulated and covered by the middle member to prevent slippage of the arm members during twisting and all other movement between the arm members and the middle member;

the arm members having second ends which extend outwardly from the middle member, each second end including coupling means adapted for connection to an attachment taken from the set consisting of handle means for gripping by a user and attachment means for connection to an object to allow relative movement and twisting between opposite arm members for exercise purposes; and said middle member being deformable and twistable by a user from an original position allowing said arm members to be moved towards one another and to be twisted with respect to said middle member, while providing resistance to such movement and resiliently returning to said original position after deformation and twisting of said middle member.

2. The device of claim 1 wherein the ends of the arm members encapsulated by the middle member include a bonding material means to enhance the secure nonreleasable junction.

3. An exercise device for development of the body of an exerciser, comprising:

an elastomeric middle member, including cavities in opposite ends;

first and second oppositely extending arms having securement ends which are insertable into the cavities of opposite ends of the middle member to provide a secure and nonreleasable junction between the middle member and the arms, all surfaces of each first end being encapsulated and covered by the middle member to prevent slippage of the arm members during twisting and all other movement between the arm members and the middle member;

the arm members having second ends which extend outwardly from the middle member, each second end including coupling means adapted for connection to an attachment taken from the set consisting of handle means for gripping by a user and attachment means for connection to an object to allow relative movement and twisting between opposite arm members for exercise purposes; and said middle member being deformable and twistable by a user from an original position allowing said arms to be moved towards one another and to be twisted with respect to said middle member, while providing resistance to such movement and resiliently returning to said original position after deformation and twisting of said middle member.

4. The device of claim 3 wherein the securement ends of the arms include a bonding material means to enhance the secure and non-releasable junction.

5. The device of claim 3 wherein the cavities in the elastomeric middle member are smaller in diameter than the outside diameter of the securement ends of the arms.

6. The device of claim 3 wherein the securement ends of the arms include enlarged portions greater in outside diameter than the outside diameter of the arms.

7. The device of claim 3 further comprising a spring means in the middle member extending generally along the longitudinal axis of the middle member.

* * * * *